US012540610B2

(12) United States Patent
Uchida et al.

(10) Patent No.: US 12,540,610 B2
(45) Date of Patent: Feb. 3, 2026

(54) PUMP STRUCTURE

(71) Applicant: OMRON HEALTHCARE Co., Ltd., Kyoto (JP)

(72) Inventors: Yuuki Uchida, Tokyo (JP); Takanori Nishioka, Kyoto (JP); Yoshihide Tokko, Kyoto (JP); Yoshihiko Sano, Kyoto (JP)

(73) Assignee: OMRON HEALTHCARE Co., Ltd., Kyoto (JP)

( * ) Notice: Subject to any disclaimer, the term of this patent is extended or adjusted under 35 U.S.C. 154(b) by 0 days.

(21) Appl. No.: 18/442,698

(22) Filed: Feb. 15, 2024

(65) Prior Publication Data

US 2024/0183349 A1 Jun. 6, 2024

Related U.S. Application Data

(63) Continuation of application No. PCT/JP2022/047200, filed on Dec. 21, 2022.

(30) Foreign Application Priority Data

Jan. 7, 2022 (JP) ..... 2022-001872

(51) Int. Cl.
*F04B 43/04* (2006.01)
*F04B 45/047* (2006.01)

(52) U.S. Cl.
CPC ..... *F04B 43/046* (2013.01); *F04B 45/047* (2013.01)

(58) Field of Classification Search
CPC ..... F04B 43/046; F04B 43/04; F04B 43/02; F04B 45/047
See application file for complete search history.

(56) References Cited

U.S. PATENT DOCUMENTS 8,747,080 B2 * 6/2014 Kodama ..... F04B 19/006
9,506,464 B2 * 11/2016 Hirata ..... H10N 30/2047
(Continued)

FOREIGN PATENT DOCUMENTS

CN 102597520 A 7/2012
CN 106062364 A 10/2016
(Continued)

OTHER PUBLICATIONS

International Search Report; 2023/03/14; PCT/JP2022/047200.
International Preliminary Report (IPRP) Issued for International Application No. PCT/JP2022/047200, Dated Nov. 9, 2023.

*Primary Examiner* — Nathan C Zollinger
(74) *Attorney, Agent, or Firm* — Colson Law Group, PLLC

(57) ABSTRACT

To provide a technology that can achieve an improvement in the characteristics of a pump configured to pump a fluid by bending vibration of a plate-shaped piezoelectric actuator and downsizing of the pump. A pump structure according to an aspect of the present disclosure includes an actuator capable of bending vibration, a fixing portion disposed to surround the actuator, and a support portion disposed integrally with the fixing portion and the actuator to connect the fixing portion and the actuator, the support portion supporting the actuator to enable the bending vibration with respect to the fixing portion. The actuator and the fixing portion are not similar in shape. The support portion includes a folded portion at which the support portion can be overlapped along the outer shape of the actuator.

11 Claims, 7 Drawing Sheets

(56) References Cited

U.S. PATENT DOCUMENTS

| | | | | |
|---|---|---|---|---|
| 9,989,047 | B2 * | 6/2018 | Chen | F04B 45/047 |
| 10,393,109 | B2 * | 8/2019 | Wu | F04B 17/003 |
| 10,487,820 | B2 * | 11/2019 | Chen | F04B 39/1066 |
| 10,920,765 | B2 * | 2/2021 | Fujisaki | F04B 53/16 |
| 11,441,555 | B2 * | 9/2022 | Tanaka | F04B 45/047 |
| 2005/0158188 | A1 * | 7/2005 | Matsui | F04B 43/043 417/559 |
| 2009/0169402 | A1 * | 7/2009 | Stenberg | H02K 33/02 417/413.1 |
| 2012/0171062 | A1 | 7/2012 | Kodama et al. | |
| 2013/0058818 | A1 * | 3/2013 | Hirata | F04B 45/047 417/479 |
| 2014/0377099 | A1 * | 12/2014 | Hsueh | F04B 43/043 417/413.2 |
| 2016/0348666 | A1 | 12/2016 | Tanaka | |
| 2017/0222122 | A1 | 8/2017 | Chen et al. | |
| 2018/0306178 | A1 | 10/2018 | Tanaka | |
| 2021/0199105 | A1 * | 7/2021 | Tanaka | F04B 45/047 |
| 2021/0355930 | A1 | 11/2021 | Tanaka et al. | |

FOREIGN PATENT DOCUMENTS

| | | | | |
|---|---|---|---|---|
| CN | 108317093 | A | 7/2018 | |
| CN | 111980887 | A * | 11/2020 | F04B 53/00 |
| CN | 109869302 | B * | 10/2024 | |
| EP | 2557312 | A1 | 2/2013 | |
| EP | 3623624 | A1 | 3/2020 | |
| GB | 2595783 | A | 12/2021 | |
| JP | 2009-97414 | A | 5/2009 | |
| JP | 2009097414 | A * | 5/2009 | |
| JP | 5177331 | B1 | 4/2013 | |
| JP | 2018-25197 | A | 2/2018 | |
| JP | 2018-28265 | A | 2/2018 | |
| KR | 10-2012-0032566 | A | 4/2012 | |
| WO | WO-2007055642 | A1 * | 5/2007 | F04B 45/047 |
| WO | 2011/145544 | A1 | 11/2011 | |
| WO | WO-2012140967 | A1 * | 10/2012 | F04B 17/003 |
| WO | 2015/125608 | A1 | 8/2015 | |
| WO | 2020/195075 | A1 | 10/2020 | |

* cited by examiner

PUMP STRUCTURE

CROSS-REFERENCE TO RELATED APPLICATIONS

This application is the U.S. national stage application filed pursuant to 35 U.S.C. 365(c) and 120 as a continuation of International Patent Application No. PCT/JP2022/047200, filed Dec. 21, 2022, which application claims priority to Japanese Patent Application No. 2022-001872, filed Jan. 7, 2022, which applications are incorporated herein by reference in their entireties.

TECHNICAL FIELD

The present invention relates to a pump structure.

BACKGROUND ART

A technology related to a pump configured to pump a fluid by bending vibration of a plate-shaped piezoelectric actuator has been developed (for example, Patent Documents 1 and 2). In the structure of the pump disclosed in Patent Documents 1 and 2, a bending vibration portion of the piezoelectric actuator is supported by a surrounding fixing portion.

CITATION LIST

Patent Literature

Patent Document 1: US 2017/222122 A
Patent Document 2: JP 5177331 B

SUMMARY OF INVENTION

Technical Problem

In order to improve the characteristics of the pump having the structure disclosed in Patent Documents 1 and 2, it is conceivable to increase the length of a support portion that supports the bending vibration portion of the piezoelectric actuator with respect to the fixing portion. This is because it is assumed that the amplitude of the piezoelectric actuator increases as the rigidity of the support portion decreases. However, in such a case, the area occupied by the piezoelectric actuator and the support portion increases, and therefore, it may be difficult to downsize the pump.

Accordingly, in order to realize downsizing, it is conceivable to form the support portion in a short linear shape and to increase the rigidity of the support portion such that the support portion can support the piezoelectric actuator. However, in such a case, the amplitude of the piezoelectric actuator decreases, and thus the characteristics of the pump may be deteriorated. Therefore, although it is conceivable to process the support portion to reduce thickness, in such a case, the support portion may be formed having excessively low rigidity due to decreased processing accuracy. In other words, it may be difficult for the pump having the structure disclosed in Patent Documents 1 and 2 to achieve an improvement in the characteristics and downsizing in a compatible manner.

The present invention has been made in view of such circumstances, and an object of the present invention is to provide a technology that can achieve an improvement in the characteristics of a pump configured to pump a fluid by bending vibration of a plate-shaped piezoelectric actuator and downsizing of the pump in a compatible manner.

Solution to Problem

The present invention adopts the following configurations in order to achieve the above-mentioned object.

In other words, a pump structure according to an aspect of the present invention includes: an actuator formed in a plate shape and having a plate surface capable of bending vibration by action of an element having a piezoelectric effect;

a fixing portion disposed to surround the actuator at a predetermined interval from an outer shape of the actuator in a plate surface direction; and a support portion disposed integrally with the fixing portion and the actuator to connect the fixing portion and the actuator, the support portion supporting the actuator to enable the bending vibration with respect to the fixing portion. The actuator and the fixing portion are not similar in shape. When a virtual line passing through a center point of the actuator is drawn on the plate surface, the support portion is disposed at a location where a difference between a distance from the center point to an outer shape of the fixing portion intersecting with the virtual line and a distance from the center point to the outer shape of the actuator intersecting with the virtual line is largest. The support portion includes a folded portion at which the support portion can be overlapped along the outer shape of the actuator.

According to such a configuration, the support portion includes the folded portion, and thus the entire length of the support portion can be increased. Therefore, the rigidity of the support portion is decreased, and the amplitude of the bending vibration of the actuator supported by the support portion increases. As a result, the pump function is improved. Further, according to the configuration, even in a case where the entire length of the support portion is long, the support portion can be folded back and overlapped, and thus the size of the support portion can be reduced. Therefore, downsizing of the pump can be realized. Furthermore, according to the configuration, the location where the support portion is disposed is the largest region of the regions occupied by the fixing portion if the support portion does not exist. Therefore, according to the configuration, it is obvious that by providing the support portion in such a location, a space is effectively utilized and the entire pump is downsized.

In the pump structure according to the aspect described above, the support portion may include a first end portion connected to the actuator and a second end portion connected to the fixing portion. The first end portion and the second end portion may be one each, and the first end portion and the second end portion may be disposed side by side on the virtual line.

According to such a configuration, the first end portion and the second end portion are disposed side by side on the virtual line when viewed from the center point. Therefore, the actuator is stably supported with respect to the fixing portion. As a result, the bending vibration of the actuator is stabilized.

In the pump structure according to the aspect described above, the support portion may be disposed symmetrically with respect to the virtual line.

According to such a configuration, the structure of the support portion is a branched structure symmetrical with respect to the virtual line. Therefore, the support portion can stably support the actuator. As a result, the bending vibration of the actuator is stabilized.

In the pump structure according to the aspect described above, when the virtual line is a center line, the support portion may be disposed in one of portions into which a region is divided by the center line.

According to such a configuration, the region occupied by the support portion along the outer shape of the actuator can be reduced. Therefore, downsizing of the pump can be realized.

In the pump structure according to the aspect described above, the support portion may be folded up into concertinas.

According to such a configuration, the entire length of the support portion can be further increased. Therefore, the rigidity of the support portion is decreased. Consequently, the amplitude of the bending vibration of the actuator supported by the support portion increases. As a result, the pump function is improved. In addition, according to the configuration, since the support portion is folded up into concertinas, the size of the support portion can be reduced. Therefore, downsizing of the pump can be realized.

In the pump structure according to the aspect described above, the actuator may have a disk shape, the outer shape in the plate surface direction of the fixing portion may be rectangular, and the support portion may include support portions disposed at four corners of the fixing portion.

According to such a configuration, the location where the support portion is disposed is the largest region of the regions occupied by the fixing portion if the support portion does not exist. Therefore, according to the configuration, it is obvious that by providing the support portion in such a location, a space is effectively utilized and the entire pump is downsized. In addition, since the support portion is disposed in such a position, the actuator can be supported symmetrically with respect to the center point of the actuator. As a result, the pump can be downsized and the bending vibration of the actuator can be stabilized.

In the pump structure according to the aspect described above, the support portion may be provided with a slit having a substantially constant width.

According to such a configuration, the aspect ratio between the depth and width of the slit is substantially constant. Therefore, when the slit is formed by etching, the occurrence of a difference in etching rate depending on the location is suppressed.

In the pump structure according to the aspect described above, the support portion may be rounded at an intersecting portion between surfaces orthogonal to the plate surface direction.

According to such a configuration, stress acting on the rounded intersecting portion can be reduced. Therefore, breakage of the support portion can be suppressed. In addition, since the intersecting portion is rounded, the support portion is downsized.

Advantageous Effects of Invention

According to the present invention, a technology can be provided that can achieve an improvement in the characteristics of a pump configured to pump a fluid by bending vibration of a plate-shaped piezoelectric actuator and downsizing of the pump.

DESCRIPTION OF EMBODIMENTS

§ 1 Configuration Example

Figure 1A:
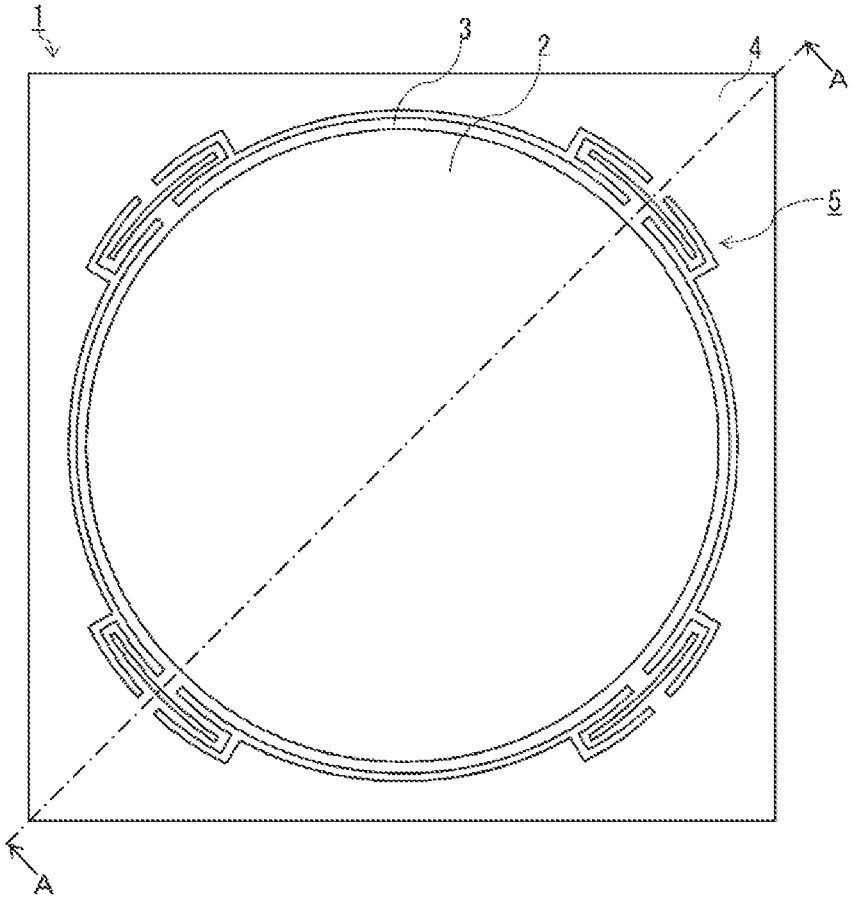
FIG. 1A and FIG. 1B illustrate an overview of a pump according to an embodiment.
Figure 1B:
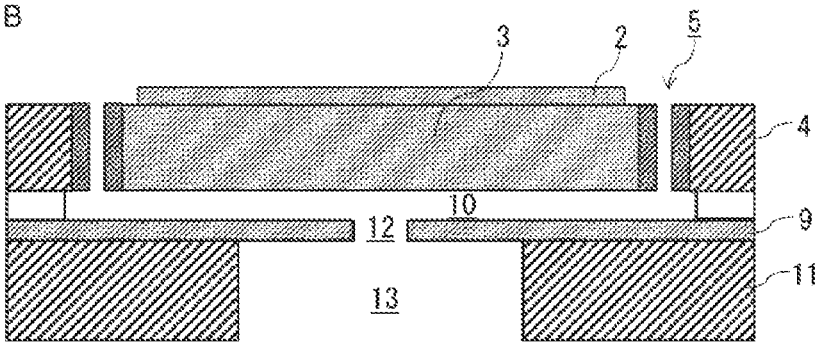

FIG. 1A and FIG. 1B illustrate an overview of a pump 1 according to the present embodiment. FIG. 1A illustrates an overview of a top view of the pump 1. FIG. 1B is an overview of a cross-sectional view taken along line A-A in FIG. 1A. As illustrated in FIG. 1A and FIG. 1B, the pump 1 is provided with a disk-shaped piezoelectric element 2. When a voltage is applied to the piezoelectric element 2, a plate surface bends and vibrates due to a piezoelectric effect. Likewise, a disk-shaped vibration plate 3 is fixed to a lower surface of the piezoelectric element 2. The vibration plate 3 is, for example, an SOI (Silicon On Insulator) and vibrates following the bending vibration of the piezoelectric element 2. Note that the piezoelectric element 2 and the vibration plate 3 are examples of an "actuator" of the present disclosure.

Further, the pump 1 is provided with a fixing plate 4 disposed around the vibration plate 3. The fixing plate 4 has a rectangular shape, and the fixing plate 4 is, for example, an SOI as with the vibration plate 3. Furthermore, the fixing plate 4 is disposed at a predetermined interval from the vibration plate 3 in the plate surface direction. Further, the pump 1 is provided with a support portion 5 between the vibration plate 3 and the fixing plate 4. The support portion 5 is connected to both the fixing plate 4 and the vibration plate 3. Furthermore, the support portion 5 supports the vibration plate 3 with respect to the fixing plate 4. Additionally, the support portions 5 are disposed close to four corners of the rectangular fixing plate 4.

Also, as illustrated in FIG. 1B, the pump 1 is provided with a movable plate 9 with a Gap10 from the vibration plate 3. Further, a base plate 11 is disposed on a lower surface of the movable plate 9. The movable plate 9 and the base plate 11 are, for example, SOIs as with the vibration plate 3. Furthermore, a hole 12 and a hole 13 are respectively disposed in the centers of the movable plate 9 and the base plate 11.

Figure 2:
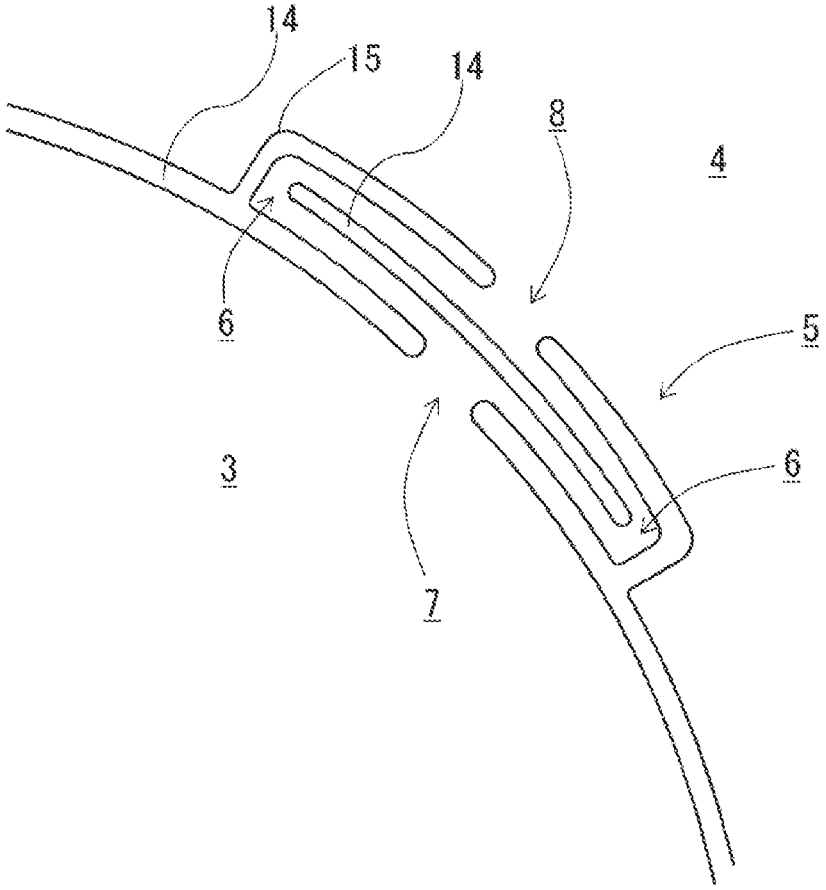
FIG. 2 is an example of a partially enlarged view of a support portion.

FIG. 2 is an example of a partially enlarged view of the support portion 5. As illustrated in FIG. 2, the support portion 5 is branched from an end portion 7 (an example of a "first end portion" of the present disclosure) that is a connection portion with the vibration plate 3, and is disposed along the outer shape of the vibration plate 3. In addition, the branched support portion 5 is folded back at a folded portion 6 to be integrated at an end portion 8 (an example of a "second end portion" of the present disclosure) that is a connection portion with the fixing plate 4. The end portion 8 is disposed on an extension of a virtual line connecting the center point of the vibration plate 3 and the end portion 7. Moreover, the support portion 5 has a symmetrical shape with respect to the virtual line. Further, the support portion 5 is provided with a slit 14 in parallel with the outer shape of the vibration plate 3. The width of the slit 14 is substantially constant. Furthermore, an intersecting portion (for example, a portion 15) between surfaces orthogonal to the plate surface direction of the support portion 5 is rounded. As shown in FIG. 2, there is a constant distance between the fixing portion 4 and the actuator (i.e., the piezoelectric element 2 and the vibration plate 3).

The pump 1 as described above is manufactured by the following method. In other words, the structure of the pump 1 illustrated in FIG. 1A and FIG. 1B is formed by preparing SOI members, etching and bonding the SOI members, and corroding and removing a predetermined oxide film with a corrosion solution.

Figure 3A:
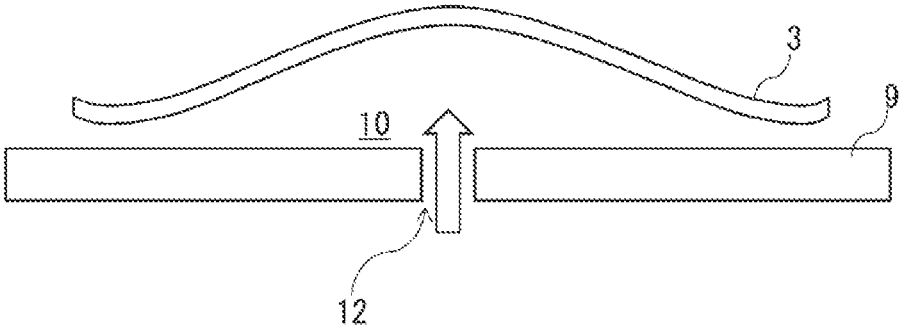
FIG. 3A and FIG. 3B illustrate an overview of an operation example of the pump.
Figure 3B:
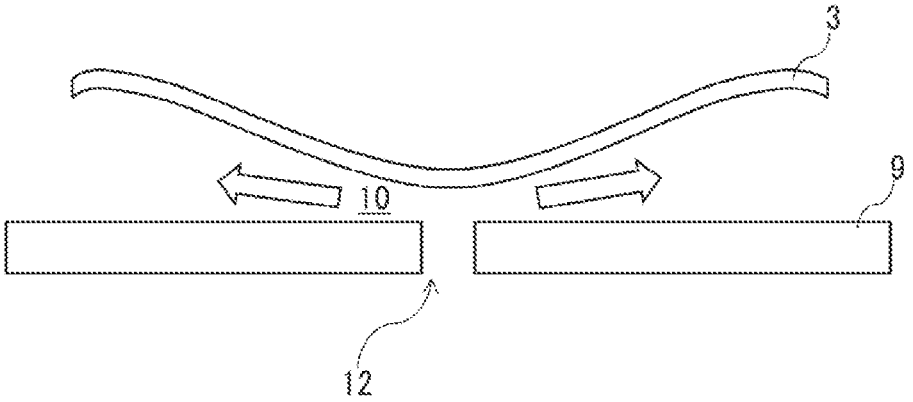

FIG. 3A and FIG. 3B illustrate an overview of an operation example of the pump 1. By controlling the voltage applied to the piezoelectric element 2 (see FIG. 1A and FIG. 1B), the piezoelectric element 2 expands in the planar direction. Then, as illustrated in FIG. 3A, the piezoelectric element 2 and the vibration plate 3 deform due to the difference in expansion between the piezoelectric element 2 and the vibration plate 3 such that the central portion protrudes upward as a whole (only the vibration plate 3 is illustrated in FIG. 3A). Thereafter, a fluid is sucked into the central portion of the Gap10 through the hole 13 of the base plate 11 and the hole 12 of the movable plate 9 (only the hole 12 is illustrated in FIG. 3A). Afterward, the voltage applied to the piezoelectric element 2 is changed, and thus the piezoelectric element 2 contracts in the planar direction. Then, as illustrated in FIG. 3B, the piezoelectric element 2 and the vibration plate 3 deform due to the difference in contraction between the piezoelectric element 2 and the vibration plate 3 such that the central portion protrudes downward as a whole. Thereafter, the fluid sucked into the central portion of the Gap10 moves toward both sides of the Gap10 in FIG. 3B. By repeatedly controlling the voltage applied to the piezoelectric element 2 as just described, the pump function is realized.

Actions and Effects

According to the pump 1 described above, since the support portion 5 is provided with the folded portion 6, the entire length of the support portion 5 can be increased. Therefore, the rigidity of the support portion 5 is decreased. Consequently, the amplitude of the bending vibration of the piezoelectric element 2 and the vibration plate 3 that are supported by the support portion 5 increases. As a result, the pump function is improved. Further, according to the pump 1 described above, even when the entire length of the support portion 5 is long, the support portion 5 can be folded back and overlapped, and thus the size of the support portion 5 can be reduced. Therefore, downsizing of the pump 1 can be realized. Furthermore, according to such a pump 1, downsizing of the pump 1 can be realized while the pump function is maintained without reducing the size of the vibration plate 3 itself.

Additionally, according to the pump 1 described above, the end portion 7 and the end portion 8 are disposed side by side on the virtual line when viewed from the center point. Therefore, the piezoelectric element 2 and the vibration plate 3 are stably supported by the fixing plate 4. As a result, the bending vibration of the piezoelectric element 2 and the vibration plate 3 is stabilized.

Moreover, according to the pump 1 described above, the structure of the support portion 5 has a branched structure that is symmetrical with respect to the virtual line passing through the end portion 7 and the end portion 8. Therefore, the support portion 5 can stably support the piezoelectric element 2 and the vibration plate 3. As a result, the bending vibration of the piezoelectric element 2 and the vibration plate 3 is stabilized.

Further, according to the pump 1 described above, the four corners of the fixing plate 4 at which the support portions 5 are disposed are the largest regions of the regions occupied by the fixing plate 4 if the support portions 5 do not exist. Thus, according to such a pump 1, it is obvious that by providing the support portions in such a location, a space is effectively utilized and the entire pump 1 is downsized. Furthermore, according to the pump 1 described above, the support portions 5 are disposed at the four corners of the rectangular fixing plate 4, and thus the support portions 5 can support the piezoelectric element 2 and the vibration plate 3 symmetrically with respect to the center point of the piezoelectric element 2. As a result, the pump 1 can be downsized and the bending vibration of the piezoelectric element 2 and the vibration plate 3 can be stabilized.

In addition, according to the pump 1 described above, the aspect ratio between the depth and width of the slit 14 of the support portion 5 is substantially constant. Therefore, when the slit 14 is formed by etching, the occurrence of a difference in etching rate depending on the location is suppressed.

Moreover, according to the pump 1 described above, the intersecting portion (for example, the portion 15) between the surfaces orthogonal to the plate surface direction of the support portion 5 is rounded. Therefore, stress acting on the rounded intersecting portion can be reduced. Therefore, breakage of the support portion 5 can be suppressed. Additionally, the intersecting portion is rounded, and thus the support portion 5 is downsized.

§ 2 Modified Examples

First Modified Example

Figure 4:
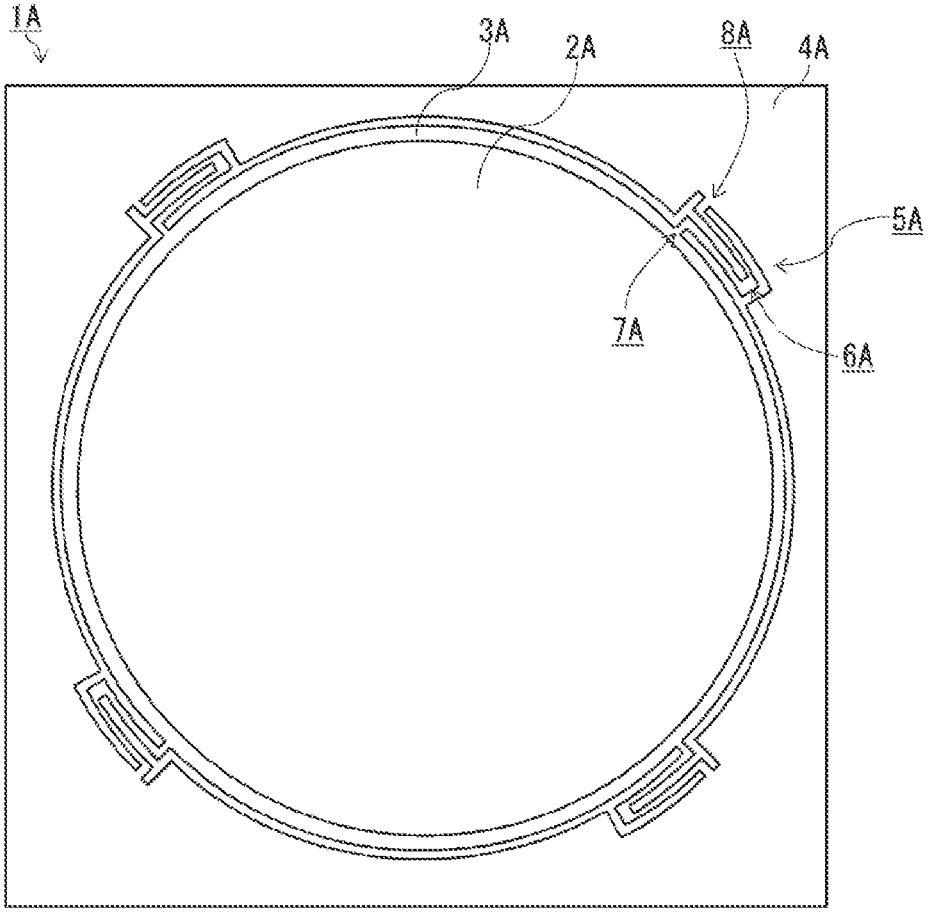
FIG. 4 illustrates an overview of a support portion according to a first modified example.

FIG. 4 illustrates an overview of a support portion 5A of a pump 1A according to a first modified example. The support portion 5A extends in one direction along the outer shape of a vibration plate 3A without branching from an end portion 7A that is a connection portion with the vibration plate 3A. Further, the support portion 5A is folded back in the opposite direction at a folded portion 6A to be connected to a fixing plate 4A at an end portion 8A. Furthermore, the end portion 8A is disposed on an extension of a line segment connecting the center point of the vibration plate 3A and the end portion 7A. In other words, when a virtual line passing through the center of the vibration plate 3A, the end portion 7A, and the end portion 8A is a center line, the support portion 5A is disposed in a region on the right side of the center line in FIG. 4. According to the pump 1A described above, the same effects as those of the pump 1 according to the embodiment are achieved. Moreover, according to the pump 1A, the region occupied by the support portion 5A along the outer shape of the vibration plate 3A can be reduced. Therefore, downsizing of the pump 1A can be realized.

Second Modified Example

Figure 5:
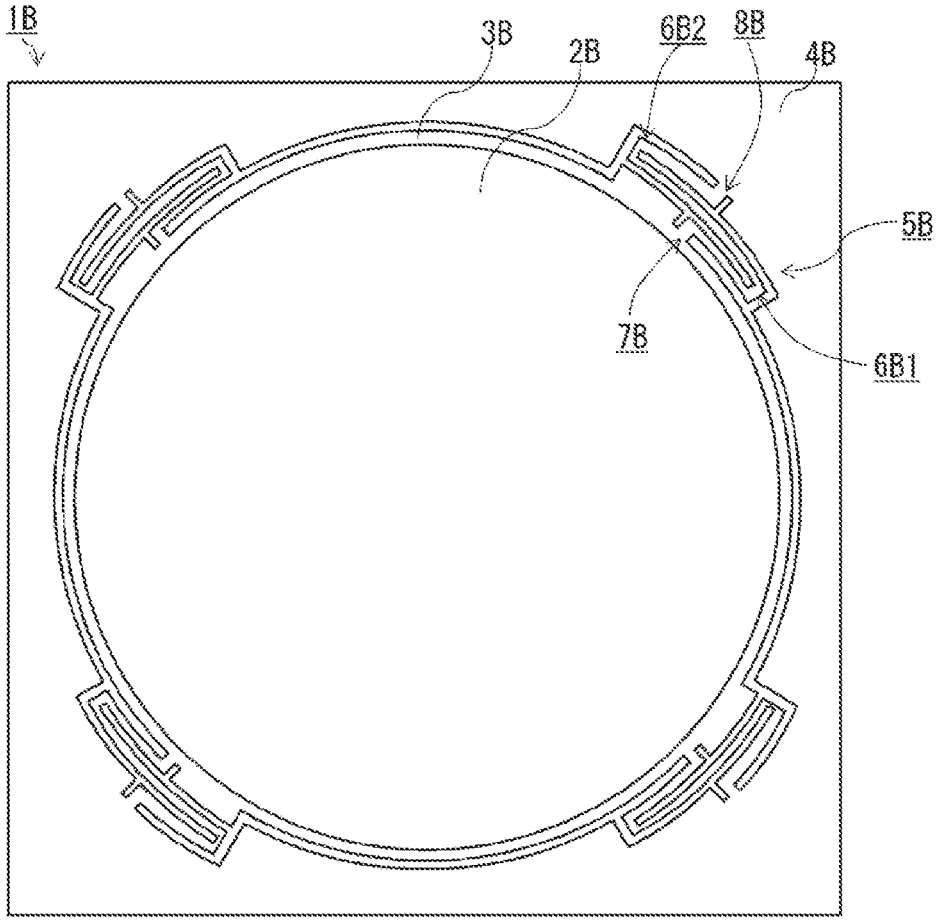
FIG. 5 illustrates an overview of a support portion according to a second modified example.

FIG. 5 illustrates an overview of a support portion 5B of a pump 1B according to a second modified example. The support portion 5B extends in one direction along the outer shape of a vibration plate 3B without branching from an end portion 7B that is a connection portion with the vibration plate 3B. Further, the support portion 5B is folded back in the opposite direction at a folded portion 6B1 to extend in the opposite direction along the outer shape of the vibration plate 3B. Furthermore, the support portion 5B is folded back again at a folded portion 6B2 to be connected to a fixing plate 4B at an end portion 8B. In addition, the end portion 8B is disposed on an extension of a line segment connecting the center point of the vibration plate 3B and the end portion 7B. In other words, the support portion 5B is folded up into concertinas.

According to the pump 1B described above, the same effects as those of the pump 1 according to the embodiment are achieved. In addition, the pump 1B can have a longer overall length of the support portion 5B. Therefore, the rigidity of the support portion 5B is decreased. Consequently, the amplitude of bending vibration of a piezoelectric element 2B and the vibration plate 3B that are supported by the support portion 5B increases. As a result, the pump function is improved.

Third Modified Example

Figure 6:
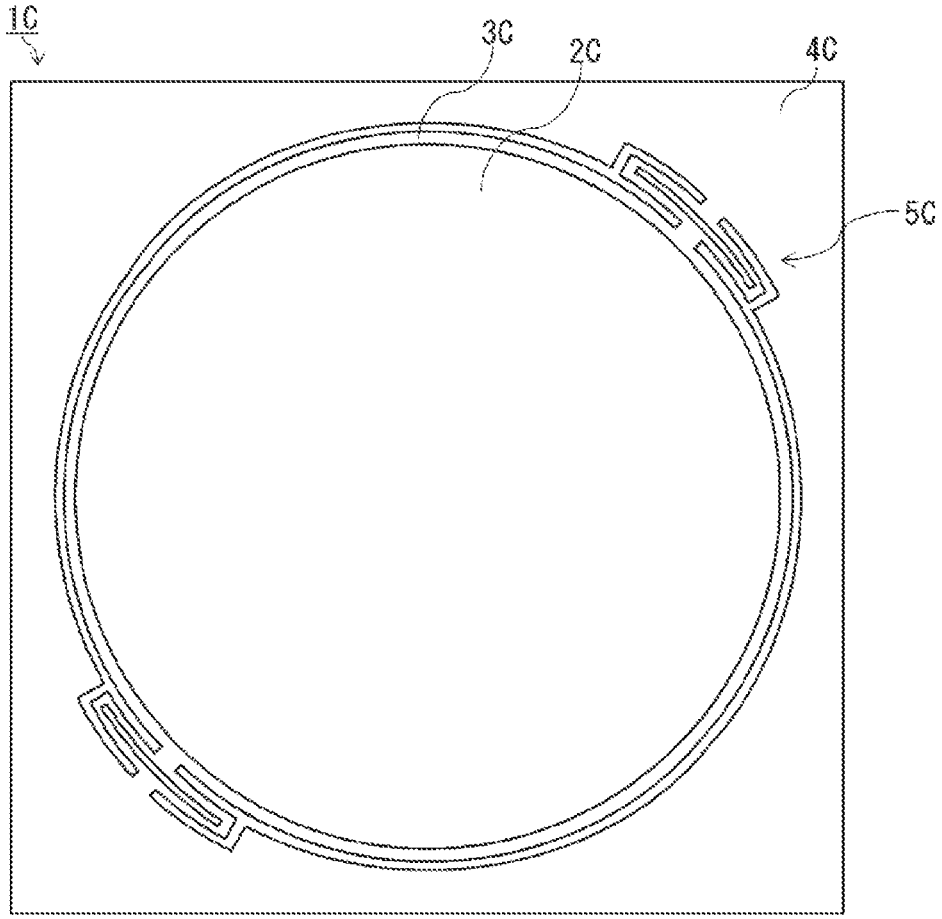
FIG. 6 illustrates an overview of a support portion according to a third modified example.

FIG. 6 illustrates an overview of a support portion 5C of a pump 1C according to a third modified example. The support portion 5C has a structure similar to that of the support portion 5 of the embodiment. However, the support portions 5C are disposed near two corners on a diagonal line of four corners of a fixing plate 4C. Also, according to the pump 1C described above, the same effects as those of the pump 1 according to the embodiment are achieved. Additionally, according to the pump 1C, the area occupied by the support portions 5C can be reduced. Therefore, the pump 1C can be further downsized.

Fourth Modified Example

Figure 7:
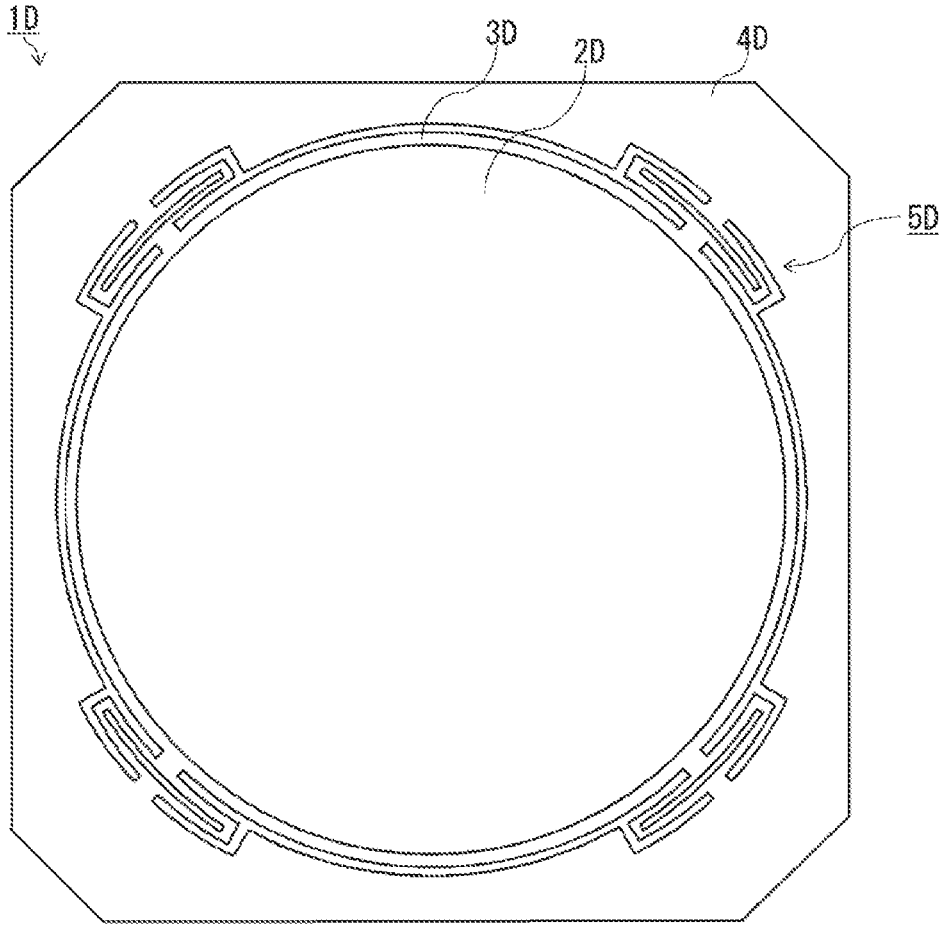
FIG. 7 illustrates an overview of a pump according to a fourth modified example.

FIG. 7 illustrates an overview of a pump 1D according to a fourth modified example. The shape of a fixing plate 4D of the pump 1D is not a rectangular shape as the fixing plate 4 of the pump 1 according to the embodiment, but is a polygonal shape. In addition, a support portion 5D is disposed at a location in which when a virtual line passing through the center point of a vibration plate 3D is drawn, the difference between a distance from the center point to the outer shape of the fixing plate 4D intersecting with the virtual line and a distance from the center point to the outer shape of the vibration plate 3D intersecting with the virtual line is the largest. Also, according to the pump 1D described above, the same effects as those of the pump 1 according to the embodiment are achieved.

Other Modified Examples

There may be a plurality of end portions 7 that are connection portions between the support portion 5 and the vibration plate 3 and a plurality of end portions 8 that are connection portions between the support portion 5 and the fixing plate 4. Further, the end portion 7 and the end portion 8 may not be disposed on the virtual line passing through the center point of the vibration plate 3. Furthermore, the shapes of the vibration plate 3 and the fixing plate 4 are not limited to the aforementioned example and may be any shapes as long as the vibration plate and the fixing plate are not similar in shape. In addition, the width of the slit 14 of the support portion 5 may not be substantially constant. Moreover, the portion 15 and the like (see FIG. 2) of the support portion 5 may not be rounded.

The embodiments and modified examples disclosed above can be combined with each other.

REFERENCE NUMERALS LIST

1: Pump
2: Piezoelectric element
3 Vibration plate
4: Fixing plate
5: Support portion
6: Folded portion
7: End portion
8: End portion
9: Movable plate
11: Base plate
12: Hole
13: Hole
14: Slit
15: Portion

The invention claimed is:

1. A pump structure comprising:

an actuator formed in a plate shape and having a plate surface capable of bending vibration by action of an element having a piezoelectric effect;

a fixing portion disposed to surround the actuator at a predetermined interval from an outer shape of the actuator in a plate surface direction; and a support portion disposed integrally with the fixing portion and the actuator to connect the fixing portion and the actuator, the support portion supporting the actuator to enable the bending vibration with respect to the fixing portion, wherein the actuator and the fixing portion are not similar in shape, when a virtual line passing through a center point of the actuator is drawn on the plate surface, the support portion is disposed at a location where a difference between a distance from the center point to an outer shape of the fixing portion intersecting with the virtual line and a distance from the center point to the outer shape of the actuator intersecting with the virtual line is largest, the support portion includes a folded portion at which the support portion can be overlapped along the outer shape of the actuator, a first end portion connected to the actuator, and a second end portion connected to the fixing portion, the first end portion and the second end portion are one each, the support portion is branched from the first end portion, and the branched support portion is folded back at the folded portion to be integrated at the second end portion, and a slit in parallel with the outer shape of the actuator is formed in the support portion, wherein a distance between the fixing portion and the actuator is constant.

2. The pump structure according to claim 1 wherein the first end portion and the second end portion are disposed side by side on the virtual line.

3. The pump structure according to claim 2, wherein the support portion is disposed symmetrically with respect to the virtual line.

4. The pump structure according to claim 1, wherein the actuator has a disk shape, the outer shape in the plate surface direction of the fixing portion is rectangular, and the support portion includes support portions disposed at four corners of the fixing portion.

5. The pump structure according to claim 1, wherein the support portion is rounded at an intersecting portion between surfaces orthogonal to the plate surface direction.

6. A pump structure comprising:

an actuator formed in a plate shape and having a plate surface capable of bending vibration by action of an element having a piezoelectric effect;

a fixing portion disposed to surround the actuator at a predetermined interval from an outer shape of the actuator in a plate surface direction; and a support portion disposed integrally with the fixing portion and the actuator to connect the fixing portion and the actuator, the support portion supporting the actuator to enable the bending vibration with respect to the fixing portion, wherein the actuator and the fixing portion are not similar in shape, when a virtual line passing through a center point of the actuator is drawn on the plate surface, the support portion is disposed at a location where a difference between a distance from the center point to an outer shape of the fixing portion intersecting with the virtual line and a distance from the center point to the outer shape of the actuator intersecting with the virtual line is largest, the support portion includes a folded portion at which the support portion can be overlapped along the outer shape of the actuator, a first end portion connected to the actuator, and a second end portion connected to the fixing portion, the first end portion and the second end portion are one each, the support portion is branched from the first end portion, and the branched support portion is folded back at the folded portion to be integrated at the second end portion, and a slit in parallel with the outer shape of the actuator is formed in the support portion, wherein the support portion extends in one direction along an outer shape of the actuator without branching.

7. The pump structure according to claim 6, wherein a distance between the fixing portion and the actuator is constant.

8. The pump structure according to claim 6 wherein the first end portion and the second end portion are disposed side by side on the virtual line.

9. The pump structure according to claim 8, wherein the support portion is disposed symmetrically with respect to the virtual line.

10. The pump structure according to claim 6, wherein the actuator has a disk shape, the outer shape in the plate surface direction of the fixing portion is rectangular, and the support portion includes support portions disposed at four corners of the fixing portion.

11. The pump structure according to claim 6, wherein the support portion is rounded at an intersecting portion between surfaces orthogonal to the plate surface direction.

* * * * *